United States Patent [19]

Wellborn

[11] 4,316,711

[45] Feb. 23, 1982

[54] CARTRIDGE FILTER FOR SPIN-PACK ASSEMBLIES

[75] Inventor: James L. Wellborn, Stuarts Draft, Va.

[73] Assignee: E. I. Du Pont de Nemours and Company, Wilmington, Del.

[21] Appl. No.: 175,388

[22] Filed: Aug. 5, 1980

[51] Int. Cl.[3] ..... D01D 1/10

[52] U.S. Cl. ..... 425/198; 210/282; 425/199

[58] Field of Search ..... 210/266, 282, 287; 425/197–199

[56] References Cited

U.S. PATENT DOCUMENTS

| | | | |
|---|---|---|---|
| 2,562,735 | 7/1951 | Pick | 210/282 |
| 3,028,627 | 4/1962 | McCormick | 425/199 |
| 3,785,497 | 1/1974 | Giffard | 210/282 |
| 4,107,045 | 8/1978 | Turetsky | 210/282 |

*Primary Examiner*—Ivars C. Cintins

[57] ABSTRACT

A cartridge filter is provided in which a powdered filter medium is encapsulated between screens which are sealed to the side wall of the cartridge. The side wall has a flange which engages the upper surface of a holder into which the cartridge fits. The holder is part of a spin-pack assembly in which the cartridge filters fiber-forming material immediately before the material passes through spinneret capillaries and is formed into filaments.

5 Claims, 5 Drawing Figures

CARTRIDGE FILTER FOR SPIN-PACK ASSEMBLIES

BACKGROUND OF THE INVENTION

1. Field of the Invention

This invention relates to spin-pack assemblies wherein fiber-forming material is filtered just before being spun into filaments. More particularly, it concerns a cartridge filter for use in such spin-pack assemblies.

2. Description of the Prior Art

Spin-pack assemblies wherein fiber-forming material is filtered just upstream of the spinneret capillaries are well known in the art. For example, U.S. Pat. No. 3,896,028 discloses a spin-pack assembly for use in melt spinning of polymers into filaments. Similar assemblies are known in which solutions of polymers are fltered immediately upstream of the spinnerets prior to wet or dry spinning of the fiber-forming material into filaments.

A typical spin-pack assembly has a chamber within which a filter medium is contained between screens. The inlet to the chamber is in communication with a source of supply of the fiber-forming material and the outlet of the chamber is in communication with the spinneret capillaries. The screens are usually of a very fine wire mesh.

In a commonly used commercial operation, the filter portion of the spin-pack assembly is made up by laying an exit screen on a support grid at the exit of the chamber. Then a filter medium, such as the powdered sintered metal disclosed in U.S. Pat. No. 3,896,028, is poured into the chamber and a second screen is placed atop the filter medium. However, with such a filter, difficulties are encountered in assuring that the exit screen is seated properly and that no by-passing of fiber-forming material or filter medium occurs around the edges of the exit screen. To assure better sealing around the edges of the exit screen, a ring of soft, deformable metal is swaged atop the exit screen and against the wall of the chamber. However, this too has not been entirely satisfactory. Pieces at the edge of the screen sometimes break off and fall into the spinneret capillaries. Also, replacement of such filter assemblies and repeated swaging can cause undesirable wear on the chamber wall and deformation of the support grid. In addition, when the filter holder contains more than one chamber, such as is often the case in dry spinning of filaments wherein a dozen or so chambers are located in the same holder, nonuniform loading of the filter medium and contamination of the spinneret capillaries with fine, broken pieces of the screen or with filter medium powder can occur. Furthermore, the handling of the loose, powdered filter medium, screens, etc. and assembling the materials into the filter holder chamber involve costly and time-consuming operations.

In view of the difficulties with prior-art spin-pack assemblies, it is an object of the present invention to provide a filter which is assembled separately and fitted into the spin assembly holder easily, quickly and without any loose filter medium powder contaminating other parts of the pack.

SUMMARY OF THE INVENTION

The present invention provides an improvement in a spin-pack assembly. The spin-pack assembly is of the type that includes a filter body which contains a chamber for holding a filter medium between screens. The chamber has an inlet end in the upper surface of the holder. The inlet end communicates with a source of fiber-forming material which is supplied through a spinning block. The chamber also has an outlet end which communicates with a spinneret plate. The improvement of the present invention comprises a cartridge which fits into the chamber. The cartridge has (a) an upstanding continuous side wall whose inner surface forms a continuous passage, the inlet and outlet ends of which correspond in location to the inlet and outlet ends of the chamber, (b) a flange extending outwardly from the inlet end of the side wall, which flange engages the upper surface of the holder, (c) a first screen in the inlet end and a second screen in the outlet end of the passage of the side wall, each screen being sealed to the side wall and (d) a powdered filter medium being contained in the passage between the screens.

In preferred embodiments, in which the cartridge is to be used in a spin-pack assembly for dry or wet spinning of fiber-forming material, the side wall is made of a thermoplastic material and the edges of the screens are imbedded and heat sealed through the inner surface of the side wall. In preferred embodiments, in which the cartridge is to be used in spin-pack assemblies for melt spinning of fiber-forming polymer, the side wall is made of metal and the edges of the screens are sealed to the wall by swaging.

In another preferred embodiment, the flange is sandwiched between a lower portion of the spinning block and the upper surface of the holder to form a seal around the inlet to the cartridge. In a still further preferred embodiment, the holder has a recess to receive the cartridge flange.

BRIEF DESCRIPTION OF THE DRAWINGS

The invention will be more readily understood by reference to the drawings wherein.

DETAILED DESCRIPTION OF PREFERRED EMBODIMENTS

Figure 1:
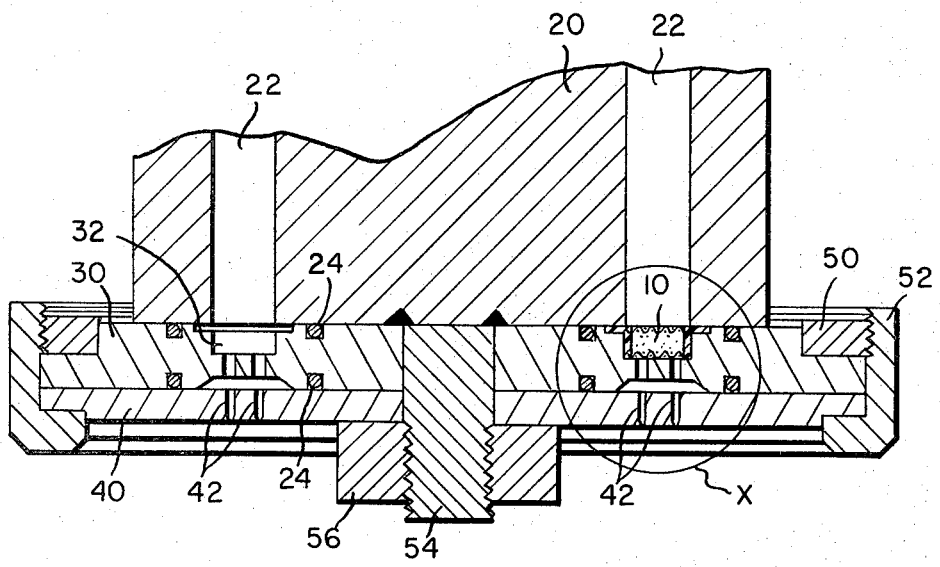
FIG. 1 is a vertical cross-section through the lower end of a typical spin-pack assembly in which a cartridge of the present invention is incorporated.

The filament spinning apparatus chosen for illustration of the present invention is depicted in FIG. 1. The apparatus includes a spinning block 20 through which are passages 22 for fiber-forming material to be supplied to a filter cartridge 10 of the invention. Holder 30, which contains chambers 32, and spinneret plate 40, which contains spinneret capillaries 42, are held together by means of ring nut 50 and retaining ring 52. These assembled components are connected to spinning block 20 by means of stud 54, which is welded to the block, and stud nut 56. Gaskets 24 provide seals between block 20 and holder 30 around the inlets to chambers 32 and between holder 30 and spinneret plate 40 around the outlets to chambers 32.

Figure 2:
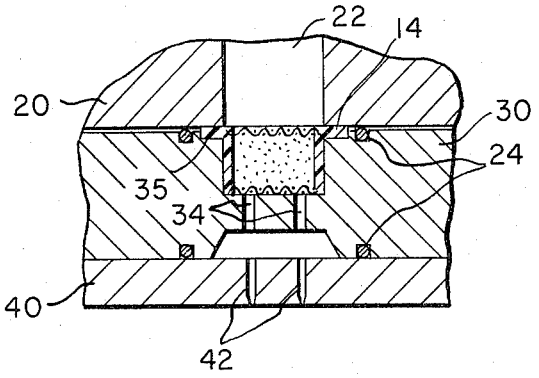
FIG. 2 is an enlarged view of the portion "X" of FIG. 1.
Figure 3:
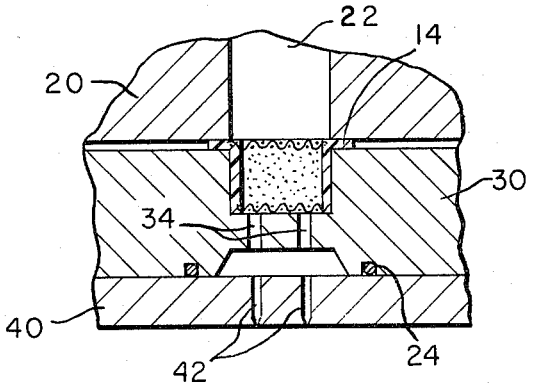
FIG. 3 is another enlarged view of portion "X" in which another embodiment of the invention is incorporated.

Chambers 32 of holder plate 30 are adapted to contain filter media and screens. Chamber 32 on the left side of FIG. 1 is shown empty, whereas chamber 32 on the right side of FIG. 1 is shown containing a filter cartridge 10 of the present invention. Chamber 32 is aligned with passage 22 which supplies the fiber-forming material from block 20. As shown in FIGS. 2 and 3, holder passages 34 located immediately downstream of chamber 32 permit fiber-forming material to pass through holder 30 to spinneret plate 40. The walls of passages 34 also provide a support grid for the filter medium and screens. Appropriate gaskets 24, which for melt spinning usually are of a suitable metal and for wet or dry spinning usually are elastomeric O-rings, form seals between spinning block 20 and holder plate 30 and between spinneret plate 40 and holder plate 30. The fiber-forming material from holder passages 34 finally passes through the spinneret capillaries 42 of spinneret plate 40 to form filaments.

In one preferred embodiment, shown in FIG. 2, filter holder 30 is provided with a shallow recess 35 into which flange 14 of the filter cartridge is seated. During operation, the pressure drop created by the passage of fiber-forming material through the filter cartridge causes a seal to be formed between flange 14 and the surface of recess 35. As shown in FIG. 3, flange 14 also can act as a seal between spinning block 20 and holder 30, when the flange is sandwiched between the lower surface of spinning block 20 and the upper surface of holder 30. When flange 14 acts as such a seal, gaskets 24 in the upper surface of holder 30 are obviated.

Figure 4:
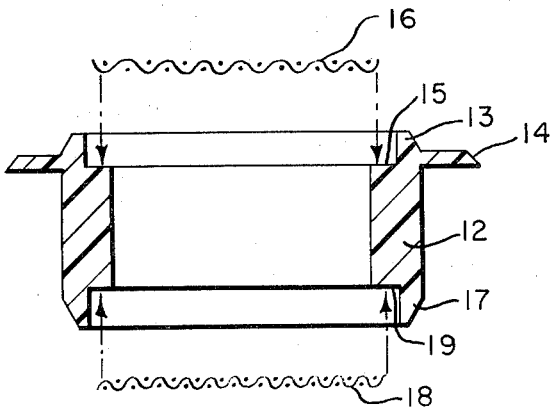
FIG. 4 is an enlarged exploded view in longitudinal cross-section of components of the cartridge of the invention prior to assembly.

FIG. 4 shows the components of the filter cartridge without the powdered filter medium. In particular, FIG. 4 shows a suitable longitudinal cross-section for continuous upstanding side wall 12 before the cartridge is completed. Side wall 12 includes on its inner surface shoulders 15 and 19 located near the inlet and outlet ends, respectively of side wall 12. Inlet screen 16 and outlet screen 18 are adapted to fit on shoulders 15 and 19, respectively. When the screens are in position on the shoulders, lips 13 and 17 are forced over screens 16 and 18, respectively, to form seals between the screens and the side wall. When the side wall is made of a thermoplastic material (e.g., nylon) the side wall lips 13 and 17 are heated and then deformed so that the edges of the screens become embedded in the side wall and heat-sealed thereto. When the side wall is made of a metal (e.g., aluminum) side wall lips 13 and 17 are swaged over the edge of the screens to seal the screens to the side wall.

A convenient method of fabricating a complete filter cartridge of the invention will be illustrated by the following steps in which a thermoplastic sidewall is employed. A mandrel is inserted from the inlet end of side wall 12 into the internal passage of the side wall such that the top of the mandrel, which is flat, is on the same level as outlet shoulder 19. Outlet screen 18 is then placed on shoulder 19 and is held in place, for example, by a hold-down pin, while an annular heater element having a flat end is brought down into contact with the bevelled edge of lip 17. As lip 17 is heated, it softens and is deformed by the downward pressure of the flat end of the heater element, such that the lip heat-seals outlet screen 18 to side wall 12. The thusly formed partial assembly is then, in sequence: (a) removed from the mandrel; (b) turned upside down (i.e., right side up); (c) placed in a cavity approximating the size of the chamber in which the final cartridge will be used so that side wall 12, outlet screen 18 and flange 14 are supported by the walls of the cavity; (d) the inside passage is filled with the required amount of powdered filter medium; (e) the filter medium is compacted; and (f) inlet screen 16 is placed on shoulder 15 and held in place by a hold-down pin. Preferably, screen 16 has a slightly dished contour so that it makes full contact with the compacted filter medium, when screen 16 is placed on shoulder 15. Then, with a similar heater and in a similar manner as were used to seal outlet screen 18 to the side wall 12, inlet screen 16 is sealed to side wall 12. The completed filter cartridge is depicted in cross-section in FIG. 5. A similar method of assembly is used when the side wall is metal, except that the sealing of the screen to the wall is done by swaging.

Figure 5:
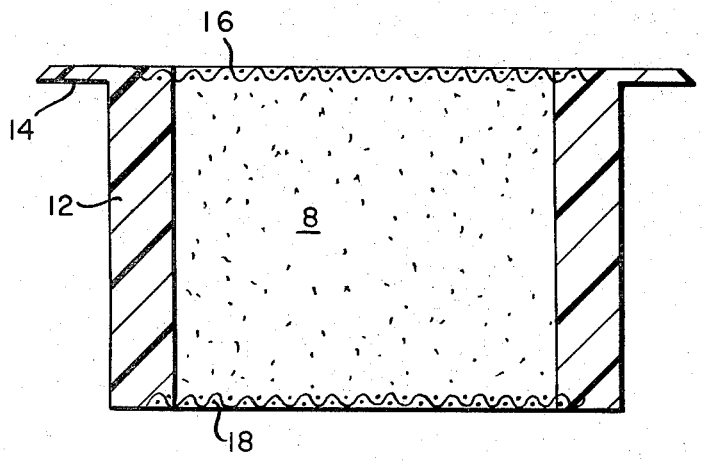
FIG. 5 is a longitudinal view of the cartridge fully assembled.

As shown in FIG. 5, the filter cartridge suitable for use in the spin-pack assemblies of the present invention has a continuous upstanding side wall 12 which forms a continuous passage having an inlet and outlet, a flange 14 extending outwardly from the inlet end of the side wall, an inlet screen 16 and an outlet screen 18, each of which is sealed to the inner surface of side wall 12, and a powdered filter medium 8 being contained in the passage between the inlet and outlet screens.

In operation, fiber-forming material is pumped from a source (not shown) through passage 22 of spinning block 20, through filter cartridge 10 and then through spinneret capillaries 42 to form filaments. The use of spin-pack assemblies of the invention which incorporate filter cartridges 10 is found to result in fewer shutdowns of operation due to extraneous material (e.g., filter medium powder or broken ends of filter screen wire) partially blocking the spin capillaries. Furthermore, filtering of the fiber-forming material was found to be more uniform because of the better uniformity that could be achieved in fabrication of the cartridge filters of the present invention as compared to those previously used. In addition, spin-pack assembly and disassembly time was drastically reduced.

I claim:

1. In a spin-pack assembly for spinning fiber-forming material into filaments, the assembly being of the type that has a spinning block, a filter holder which includes a chamber for containing a filter medium between screens, the chamber having an inlet end in the upper surface of the holder and communicating with a source of fiber-forming material that is supplied through the outlet end of the spinning block and an outlet end communicating with a spinneret plate, the improvement comprising a cartridge fitted in said chamber, said cartridge having an upstanding continuous side wall having an inner surface which forms a continuous passage having an inlet end and an exit end which correspond to the inlet and exit ends of the chamber, respectively, a flange extending outwardly from the inlet end of the side wall, said flange engaging the upper surface of the holder, a first screen in the inlet end and a second screen in the outlet end of the passage of the side wall, each screen being sealed to the side wall, and a powdered filter medium being contained in the passage between the inlet and outlet screens.

2. The assembly of claim 1 wherein the upstanding side wall is made from a thermoplastic material in which the screens are imbedded and heat-sealed.

3. The assembly of claim 1 wherein the upstanding side wall is made from a metal to which the screens are swaged.

4. The assembly of claim 1, 2 or 3 wherein a recess is provided in upper surface of the filter holder for engagement with the flange.

5. The assembly of claim 1, 2 or 3 wherein the flange is sandwiched between the upper surface of the holder and the outlet end of the spinning block whereby the flange performs as a seal between the block and the holder around the inlet to the cartridge passage.

* * * * *